United States Patent [19]

Lissy

[11] 4,453,434

[45] Jun. 12, 1984

[54] ROTARY ADJUSTING TOOL FOR USE IN INACCESSIBLE AREAS

[76] Inventor: James Lissy, 3541 N. Jugtown, Morris, Ill. 60450

[21] Appl. No.: 447,054

[22] Filed: Dec. 6, 1982

[51] Int. Cl.[3] ..... B25B 17/00

[52] U.S. Cl. ..... 81/57.29; 74/553

[58] Field of Search ..... 81/57.29, 57.28, 57.30, 81/57.31, 3 F; 74/10.22, 553, 416; 116/245, 309

[56] References Cited

U.S. PATENT DOCUMENTS

| | | | |
|---|---|---|---|
| 1,746,381 | 2/1930 | Davis | 81/DIG. 5 |
| 2,790,343 | 4/1957 | White | 81/3 F |
| 3,430,510 | 3/1969 | Hendrickson | 81/57.29 |
| 4,128,025 | 12/1978 | Main et al. | 81/57.29 |

*Primary Examiner*—James L. Jones, Jr.

*Attorney, Agent, or Firm*—Wood, Dalton, Phillips, Mason & Rowe

[57] ABSTRACT

An adjusting tool for performing precision adjustment of rotary elements disposed in inaccessible areas including an elongated barrel. A driver is rotatably mounted on one end of the barrel and has a coupling configuration for mating with the rotary element to be adjusted. An elongated shaft is journalled within the barrel and a transmission connects the same to the driver. A knob is disposed at the opposite end of the barrel and is connected to the shaft to rotate the same. A scale is carried by the actuator for movement therewith and an index device is disposed in proximity to the scale and is mounted on the tool for movement relative to the scale. A brake is employed for selectively holding the index device against movement on the tool.

8 Claims, 6 Drawing Figures

ROTARY ADJUSTING TOOL FOR USE IN INACCESSIBLE AREAS

FIELD OF THE INVENTION

This invention relates to a tool for performing mechanical adjustments, and more specifically, for performing mechanical adjustments of the type that require rotation of an element where the element is disposed in an inaccessible area. The invention also relates to an adjusting tool for making precision adjustment of the rotational position of mechanical elements.

BACKGROUND OF THE INVENTION

Every mechanic, whether professional or a so-called "do-it-yourselfer" has, at one time or another, encountered difficulty in adjusting the rotational position of a mechanical element. The difficulty becomes more pronounced as the element whose rotational position is to be adjusted becomes more and more inaccessible.

The difficulty is also accentuated where the adjustment required requires the exercise of considerable precision.

As a consequence of these difficulties, there have evolved a large variety of extensions for existing tools which are designed to be attached thereto and which may be located so as to extend into inaccessible areas and couple with the element to be adjusted. While the use of such extensions represents an improvement, such use is not without difficulties of its own. If the tool and/or extension is worn, there may exist some play at the point whereat they are coupled making it difficult to obtain a precise adjustment. Frequently, when a tool and extension are employed by relatively inexperienced persons, the two may become disassociated during the adjustment process thereby prolonging such process.

Furthermore, many tools employed provide no precise means whereby the position of a driving element coupled to the element to be adjusted, and thus the position of the element during the adjustment process, can be ascertained.

The present invention is directed to overcoming one or more of the above problems.

SUMMARY OF THE INVENTION

An exemplary embodiment made according to the invention includes an elongated barrel having opposed ends. A driver is rotatably mounted on one end of the barrel and has means for coupling with a rotary element to be adjusted. An elongated shaft is journalled within the barrel and means drivingly connect the shaft to the driver. A movable manual actuator is disposed at the other end of the barrel and is connected to the shaft so that the shaft, and thus the driver, may be rotated. First index means are associated with the actuator for movement therewith and second index means are disposed in proximity to the first index means and mounted on the tool for movement on the tool relative to the first index means. In a highly preferred embodiment, means are provided for selectively restraining the second index means against movement on the tool.

In one embodiment of the invention, the axes of rotation of the driver and the shaft are non-parallel. In a high preferred embodiment, the shaft emerges from the barrel and the actuator comprises a knob secured to the shaft. The first index means is disposed on the knob and the second index means comprises an element journalled on the shaft between the knob and the barrel. The restraining means comprises a brake engaging the second index means.

The invention further contemplates that the first index means comprise a plural character scale carried by the knob and that the second index means comprises a disc of larger diameter than the knob and having at least one reference mark immediately adjacent the scale on the side of the disc facing the knob.

For ease of interrelating the two index means, it is preferred that the first gear be a crown gear and the second gear a pinion gear with the number of gear teeth on one of the gears being an integral multiple of the number of gear teeth on the other of the gears.

Other objects and advantages will become apparent from the following specification taken in connection with the accompanying drawings.

BEST MODE OF CARRYING OUT THE INVENTION

Figures 1, 2:
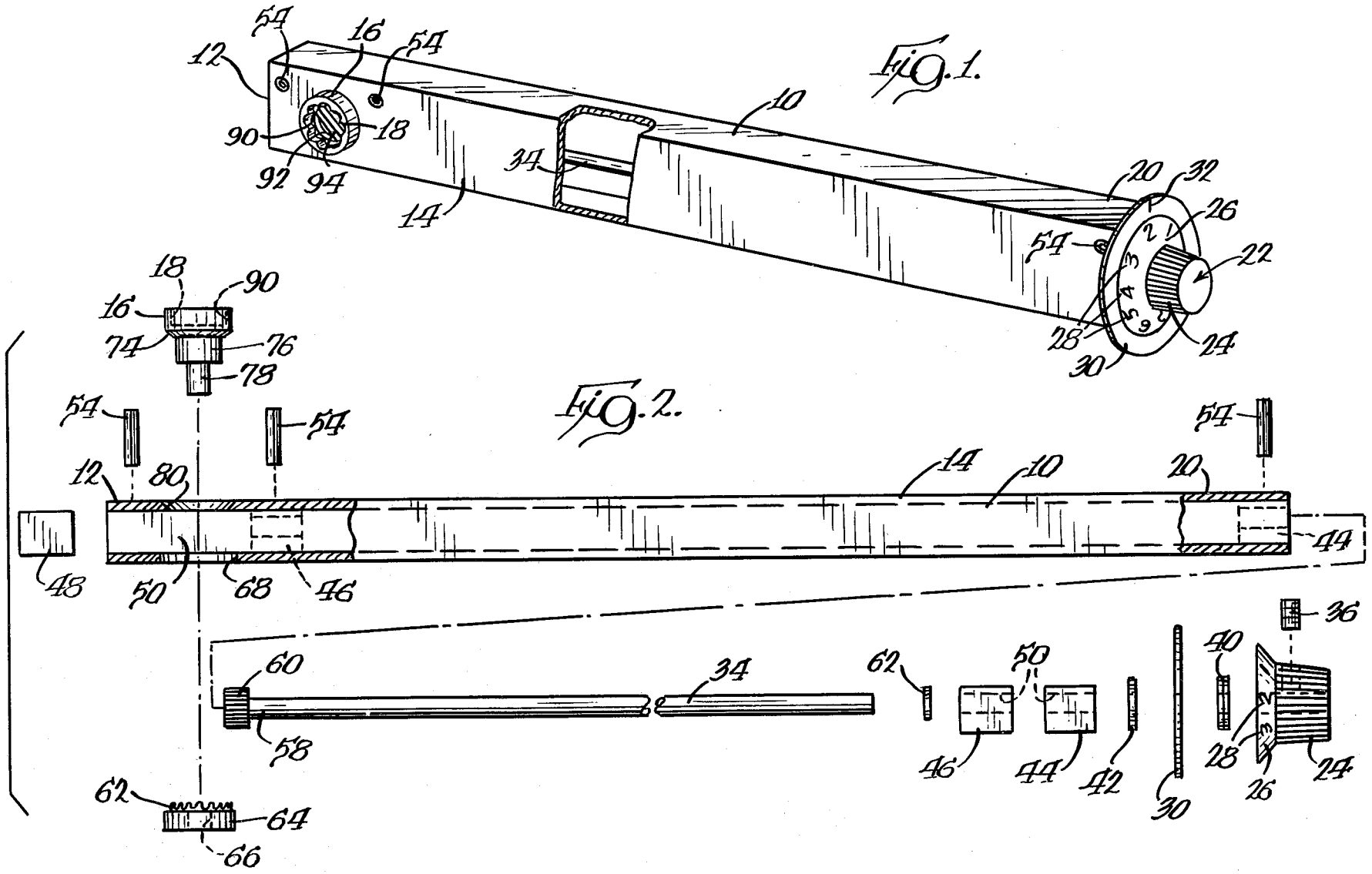
FIG. 1 is a perspective view of an adjusting tool made according to the invention.
FIG. 2 is an exploded view of the adjusting tool.

An exemplary embodiment of an adjusting tool made according to the invention is illustrated in the drawings and with reference to FIG. 1 is seen to include an elongated barrel 10. In the preferred embodiment, the barrel 10 serves as a housing for other tool components and is formed of a tube of rectangular cross-section.

At an end 12 of the barrel 10, in one side 14 thereof, there is journalled a driver 16. The driver 16 has a central recess 18 whose configuration will be described in greater detail hereinafter and which is adapted to couple with an element whose rotational position is to be mechanically adjusted.

At the opposite end 20 of the barrel 10 there is mounted a manual actuator, generally designated 22, which when turned by a user of the tool, is operative by means to be described to cause the driver 16 to rotate.

In the preferred embodiment, the actuator 22 is in the form of a knob 24 which may be manually rotated. The tool includes first index means 26 associated with the actuator 22 so as to be movable therewith. In the preferred embodiment, the first index means comprises a scale integral with the base of the knob 24 and carrying plural characters such as numbers 28.

The tool also includes a second index means 30 which is in the form of a disc having a greater diameter than that of the scale on the knob 24. The disc 30 is journalled for rotation relative to the barrel 10 and the knob 24 by means to be described and carries a reference mark 32 in immediate proximity to the scale 26 and on the side of the disc 30 facing the knob 24.

The general organization as illustrated in FIG. 1 is completed by an elongated shaft 34 within the interior of the barrel 10 which, along with other means to be described, interconnect the knob 24 and the driver 16 such that rotation of the knob 24 will cause rotation of the driver 16.

Turning now to FIG. 2, the knob 24 includes a set screw 36 by which the knob 24 may be secured to an end 38 of the shaft 34, which end projects from the end 20 of the barrel 10 when the tool is assembled. Spacing washers 40 are interposed between the knob 24 and the disc 30 and a rubber friction washer or brake 42 is disposed about the shaft 34 to abut the side of the disc 30 remote from the knob.

A first bearing block 44 is mounted in the end 20 of the barrel 10 such that the friction washer 42 is somewhat compressed between the disc 30 and the exterior surface of the bearing block 44. As a consequence, the disc 30 which is journalled on the shaft end 38 will be restrained against inadvertent movement by the friction washer acting as a brake. In other words, the friction washer 42 acts as a means for selectively restraining the disc 30 against movement on the tool.

The tool further includes a second bearing block 46 which may be identical in configuration to the bearing block 40 and as seen in FIG. 2, the bearing block 46 is disposed close to, but not at, the end 12 of the barrel 10. An end plug 48 is disposed at the end 12 for plugging the barrel end 12 and is spaced somewhat to the left of the bearing block 46 as seen in FIG. 2 to define a transmission receiving space 50 for purposes to be seen.

Figure 3:
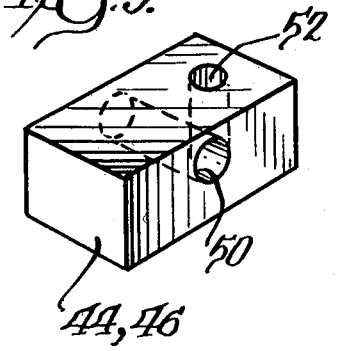
FIG. 3 is a perspective view of a bearing employed in the tool.
Figure 4:
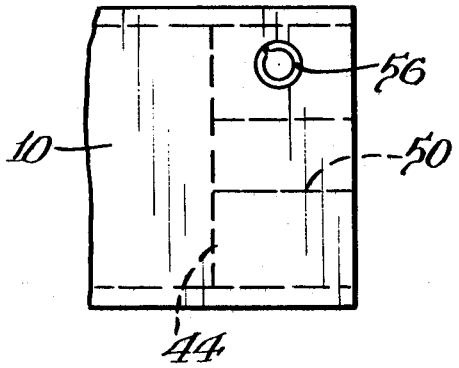
FIG. 4 is an enlarged, fragmentary view illustrating the typical means of securing certain components of the tool together.

Turning to FIG. 3, a bearing block construction usable for the bearings 44 and 46 is shown. Each bearing block is in the form of a rectangular solid of a dimension such as to snugly fit within the interior of the tube defining the barrel 10. Each block further includes two, non-intersecting, mutually transverse bores 50 and 52. The bores 50 extend along the longitudinal axis of the barrel 10 and are adapted to journal the shaft 34 within the barrel 10. The bores 52 are aligned with apertures 54 (FIG. 1) in opposite sides of the barrel 10 and are adapted to receive resilient spring pins 56 (FIG. 4) to securely mount the bearing blocks 44 and 46 in place within the barrel 10. The end plug 48 may be identical to the bearing blocks 44 and 46 except that the bore 50 is omitted. The bore 52 is retained for securement by means of a spring pin 56.

An end 58 of the shaft 34 mounts a pinion gear 60 as seen in FIG. 2 and a thrust washer 62 is interposed between the pinion 60 and the adjacent side of the bearing block 46. The pinion 60 has gear teeth meshed with gear teeth on a crown gear 62. The crown gear 62 includes an enlarged hub 64 and a central bore 66. The same is journalled within a circular opening 68 in the side 70 of the barrel opposite the side 14. The driver 16 has an enlarged head 72 containing the recess 18 which merges via a frustoconical taper 74 into an intermediate sized cylindrical section 76 which in turn ends in a stub shaft 78.

The barrel 10, on the side 14 and aligned with the opening 68, includes an opening 80 having a frustoconical side of the same taper as that of the frustoconical surface 74 on the driver 16. Thus, the surfaces 74 and 80 serve as a bearing for journalling the driver 16. With the shaft 34 and the components assembled thereto disposed within the barrel 10, the crown gear 62 is introduced into the opening 68 with the surface 64 serving as a bearing surface therein. The driver 16 is likewise introduced into the opening 80 and the stub shaft 78 is press-fit into the bore 66 in the crown gear to hold the two in assembled relation. At this time, of course, the pinion 60 will be engaged with the crown gear 62 within the transmission area 50.

Figure 5:
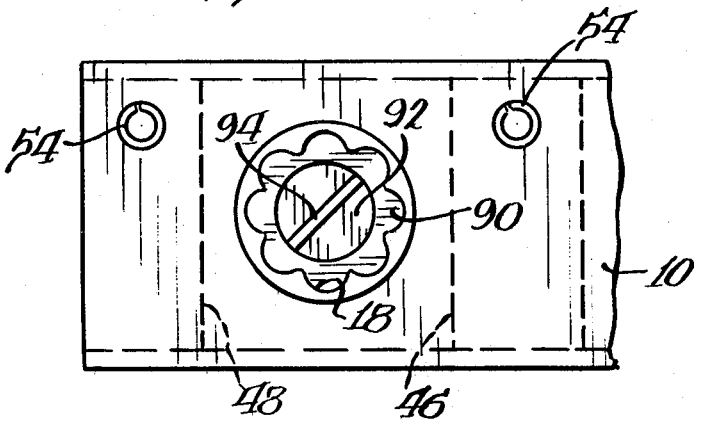
FIG. 5 is a plan view of a driver employed in the tool.

As perhaps best seen in FIGS. 1 and 5, the recess 18 includes a first step 90 having a serrated side wall. There is also provided a second step 92 having an upstanding cross member 94. The serrations of the first step 90 are adapted to mate with a rosette shaped outer surface on an element whose rotational position is to be adjusted by the tool. Alternately, the tool may be utilized to adjust the position of a slotted element such as a conventionally headed screw or the like simply by disposing the cross member 94 in the slotted head of the element to be adjusted. Of course, the invention is not restricted to either configuration illustrated as it is expressly contemplated that the head 16 may be provided with any variety of configurations dependent upon the configuration of the element to be adjusted.

INDUSTRIAL APPLICABILITY

Figure 6:
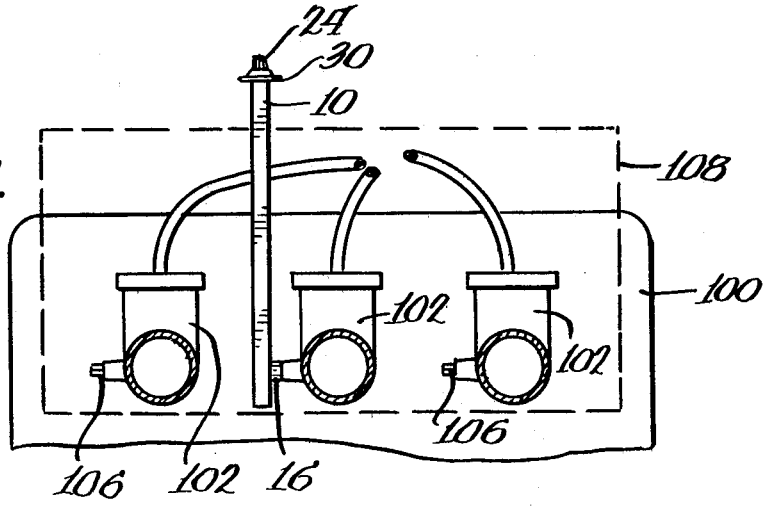
FIG. 6 is a somewhat schematic elevational view, with parts shown in section, illustrating the tool in one typical environment of intended use.

One intended use for the adjusting tool is illustrated in FIG. 6. In FIG. 6, an engine block for a known type of three cylinder, two stroke engine, commonly employed in a known type of snowmobile, is designated 100. Secured to the block 100 by any suitable means are three carburetors 102 of conventional construction, one for each cylinder. Fuel lines are shown at 104. Each carburetor 102 has an individual idle adjustment screw 106. Forwardly of each carburetor 102 is an air box 108. Consequently, the air box 108, the block 100 and the carburetors 102 themselves define extremely inaccessible areas, at least in the area of the idle adjustment screws 106 for the central and right hand carburetors 102. Other engine components or walls of an engine compartment (neither of which is shown) may similarly make access to the idle adjustment screw 106 for the left hand carburetor 102 extremely difficult.

In any event, as will be appreciated by those skilled in the art, to assure that the engine will idle properly, it is necessary that each carburetor 102 have the identical idle screw adjustment. This is, of course, a task requiring precision adjustment in any case but is made all the more difficult in the environment illustrated due to the relative inaccessibility of the idle adjustment screws 106.

A tool made according to the invention accomplishes the same in an easy fashion. First the tool is inserted into the space between carburetors 102, the block 100 and the air box 108 with the driver 16 facing the idle adjustment screw. The tool is then moved laterally and the driver 16 engaged with the adjustment screw 106. The knob 24 may then be turned to rotate the driver 16 such that the idle adjustment screw 106 engaged by the tool is driven to the end of its travel, in this case, to the maximum idle speed. At this point, second index means in the form of a disc 30 is rotated against the brake-like action provided by the friction washer 42 until the reference mark 32 is lined up with an appropriate one of the characters 28.

The knob 24 is then rotated in the opposite direction a desired number of turns or fractional turns until the desired position of adjustment is reached. During this adjustment, track is kept of the number of turns of the knob 24 and the interrelationship between the scale 26 and the reference mark 32 will precisely designate the fractional turn, if any, involved.

With that information committed to memory or otherwise recorded, the tool is then removed and placed on the adjustment screw 106 for another one of the carburetors 102. The process is repeated with the adjustment being made to the exact number of turns of the knob 24 and fractional turns as indicated by the relative position of the index means 26 and 30 to provide precise and identical adjustments of both carburetors. The process is again repeated for the third carburetor as well.

Though not necessary to the invention, in many cases, specifications or the like will dictate a preferred number of revolutions of the mechanical element to be adjusted, here the idle adjustment screws 106. In such a case, it is preferable that the number of teeth on the pinion 60 be an integral multiple of the number of teeth on the crown gear 62 so that whole number ratios will always be present. In a preferred embodiment, the pinion 60 to crown gear 62 ratio is 2:1. Using this relationship, the number of revolutions of the knob 24 will always be equal to the number of revolutions of the driver 16 multiplied by an integer. Consequently, knowing the gear ratio, the number of revolutions of the knob 24 required to rotate the driver 16 through a sufficient number of revolutions to conform to the specification is readily ascertained. However, where elements are not to be adjusted to a specification, any gear ratio desired may be employed.

From the foregoing, it will be appreciated that a tool made according to the invention is ideally suited for accomplishing (a) precision adjustments, and (b) adjustments of elements disposed in inaccessible areas. The unique interrelationship of the two index means provides for precision adjustment while the unique configuration of the tool itself enables the same to enter into inaccessible areas to adjust the rotational position of elements contained therein.

I claim:

1. An adjusting tool for use in rotatably adjusting rotary elements disposed in inaccessible areas, comprising an elongated barrel having opposed ends;

a driver rotatably mounted on one end of said barrel, and having means for coupling with a rotary element to be adjusted;

an elongated shaft journalled within said barrel;

means drivingly connecting said shaft to said driver;

a movable manual actuator at said barrel other end and connected to said shaft so that said shaft, and thus said driver, may be rotatable;

first index means associated with said actuator for movement therewith;

second index means in proximity to said first index means and mounted on said tool for movement on said tool relative to said first index means; and means for selectively restraining said second index means against movement on said tool.

2. The adjusting tool of claim 1 wherein the axes of rotation of said driver and said shaft are non-parallel.

3. The adjusting tool of claim 1 wherein said shaft emerges from said barrel other end and said actuator comprises a knob secured to said shaft; said first index means being disposed on said knob; and said second index means comprising an element journalled on said shaft between said knob and said barrel other end.

4. The adjusting tool of claim 3 wherein said restraining means comprises a brake engaging said second index means.

5. An adjusting tool for use in adjusting the rotational position of mechanical elements comprising:

an elongated, tubular housing of rectangular cross section having opposed ends;

aligned apertures in two opposed sides of said housing adjacent one end thereof;

a first gear having gear teeth within said housing journalled within one of said openings;

a driver having a head provided with means for coupling to an element to be adjusted journalled in the other of said openings and connected to said first gear to be rotated thereby;

first and second bearings within said housing adjacent opposite ends thereof;

an elongated shaft within said housing and journalled by said bearings, said shaft having an end extending from said housing other end;

a second gear mounted on said shaft within said housing and having gear teeth meshed with the gear teeth of said first gear;

a knob carrying first index means mounted on said shaft end adjacent said housing other end for rotating said shaft and ultimately said driver;

second index means journalled on said shaft end between said housing other end and said knob and rotatable relative to both said housing and said knob; and a friction brake operatively interconnecting said housing and said second index means to prevent inadvertent rotation of said second index means relative to said housing.

6. The adjusting tool of claim 5 wherein one of said driver and said first gear has a central bore and the other of said driver and said first gear includes a central stub shaft press fit within said bore.

7. The adjusting tool of claim 6 wherein said first index means comprises a plural character scale on said knob and said second index means comprises a disc of larger diameter than said knob having at least one reference mark immediately adjacent said scale on the side of said disc facing said knob.

8. The adjusting tool of claim 7 wherein said first gear is a crown gear and said second gear is a pinion gear, the number of gear teeth of said one gears being an integral multiple of the number of gear teeth on the other of said gears.

* * * * *